United States Patent [19]

LoNigro

[11] 4,149,693

[45] Apr. 17, 1979

[54] FIXTURE SUPPORT WITH TWISTED CENTRAL PORTION

[76] Inventor: Antonio LoNigro, P.O. Box 81, Chelsea, Mass. 02150

[21] Appl. No.: 857,174

[22] Filed: Dec. 2, 1977

[51] Int. Cl.[2] ..... E04B 5/52

[52] U.S. Cl. ..... 248/342; 248/228; 248/214

[58] Field of Search ..... 248/342, 343, 57, 340, 248/214, 228; 52/28, 39

[56] References Cited

U.S. PATENT DOCUMENTS

| | | | |
|---|---|---|---|
| 1,121,568 | 12/1914 | McWilliams | 248/343 |
| 1,622,087 | 3/1927 | Calderwood | 248/343 |
| 2,699,315 | 1/1955 | Appleton | 248/340 |
| 3,104,087 | 9/1963 | Budnick et al. | 248/343 |
| 3,597,889 | 8/1971 | Nigro | 248/343 X |
| 4,041,657 | 8/1977 | Schuplin | 52/28 X |

*Primary Examiner*—J. Franklin Foss

*Attorney, Agent, or Firm*—Clarence A. O'Brien; Harvey B. Jacobson

[57] ABSTRACT

A suspension unit for installation in an openwork or grid-type suspension ceiling to support a fixture-hanging junction box, the invention comprises a one-piece strap-iron supporting bar which is adapted to bridge the space between a pair of conventional inverted T-irons. The respective outer end portions of the bar include right angularly positioned downwardly opening hooks which are hooked over the respectively cooperable T-irons and are held in place by accessible setscrews. The median portion of the bar is twisted to stand edgewise and serves to adjustably mount a hanger clip which is carried by the junction box.

2 Claims, 4 Drawing Figures

FIXTURE SUPPORT WITH TWISTED CENTRAL PORTION

BACKGROUND AND SUMMARY OF THE INVENTION

This invention relates to grid-type suspended ceilings such as are currently in widespread use in modern building structures, for example, large public buildings such as shopping centers, theaters, garages, and the like, and relates more specifically to apparatus which facilitates installation of junction boxes which are capable of reliably hanging lighting fixtures and appliances which are of considerable weight.

Suspended ceilings comprised of insertable and removable ceiling panels (blocks or tiles) are structurally incapable of supporting heavy fixtures, such as lighting fixtures, and the like. Therefore, only a limited number of available fixtures are of sufficiently low weight to allow usage with such ceilings, a flush-mounted or recessed fixture of light weight usually being employed in place of a single ceiling panel. Therefore, the art has previously provided apparatus for suspending junction boxes in a suspension ceiling, such as disclosed by LoNigro, in U.S. Pat. No. 3,597,889, and by LeManquais, in U.S. Pat. No. 1,966,451, the structures disclosed therein allowing the mounting of lighting fixtures and other appliances of varying weight, size and shape. It is, therefore, to be understood that the concept of providing structure in a suspended ceiling framework capable of providing balance support means for electrical lighting fixtures is not new in the field of endeavor under consideration.

Description of further prior art structures adaptable to similar purpose is provided in U.S. Pat. No. 3,597,889, the disclosure of which patent is incorporated hereinto by reference.

The present invention provides structure similar to that disclosed in U.S. Pat. No. 3,597,889, the structure so disclosed being improved by forming the straight, substantially flat-faced median portion of the supporting bar with twisted portions near proximal end portions thereof to add strength and torsional stability to the bar. In effect, the median portion of the prior art supporting bar, major planar surfaces of which are substantially horizontally disposed in said prior art supporting bar, are turned 90 degrees so that the major planar surfaces of the bar are substantially vertically disposed, the median portion of the supporting bar remaining aligned in a substantially straight line with the proximal end portions of the bar.

The invention, therefore, provides a prefabricated adapter apparatus which comprises a length of flat-faced strap iron which is of one-piece construction and provides a substantially rigid supporting bar. This bar has a median portion, the axis of which is pivoted or twisted relative to the end portions thereof as aforesaid, the bar being sufficiently rigid to accommodate a slotted hanger clip, that is, a clip which is fastened to or otherwise carried by a slotted top wall of a conventional junction box. The respective end portions of the strap iron or bar are provided with downwardly offset bent portions. Each bent portion is L-shaped and has a horizontal portion united with a right angularly disposed downwardly opening U-shaped terminal end portion which defines a bar mounting and attaching hook. The respective hooks are fitted over the vertical flanges of customary T-irons which are employed in a ceiling frame. The outer leg or bill portion of the hook is equipped with a setscrew which permits the hook to be securely anchored. In particular, the body portion of the strap iron or bar is of a predetermined length and is straight from end to end, said body portion serving to accommodate a conventional cup-shaped junction box along the median portion thereof, particularly a junction box which has a top wall provided with a U-shaped clip. The clip has opposed spaced parallel legs which project upwardly through slots provided in the top wall of the box. The projecting portions of the legs have registering slots which are adapted to slidingly receive portions of the supporting bar medially of its length in a manner to permit a junction box to be shifted to assume and maintain a predetermined position.

It is, therefore, an object of the present invention to structurally and functionally provide improvement to prior art lighting fixtures support apparatus, particularly apparatus such as disclosed in U.S. Pat. No. 3,597,889, and to provide a junction box suspension unit capable of supporting loading encountered in the hanging of lighting fixtures and similar appliances.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
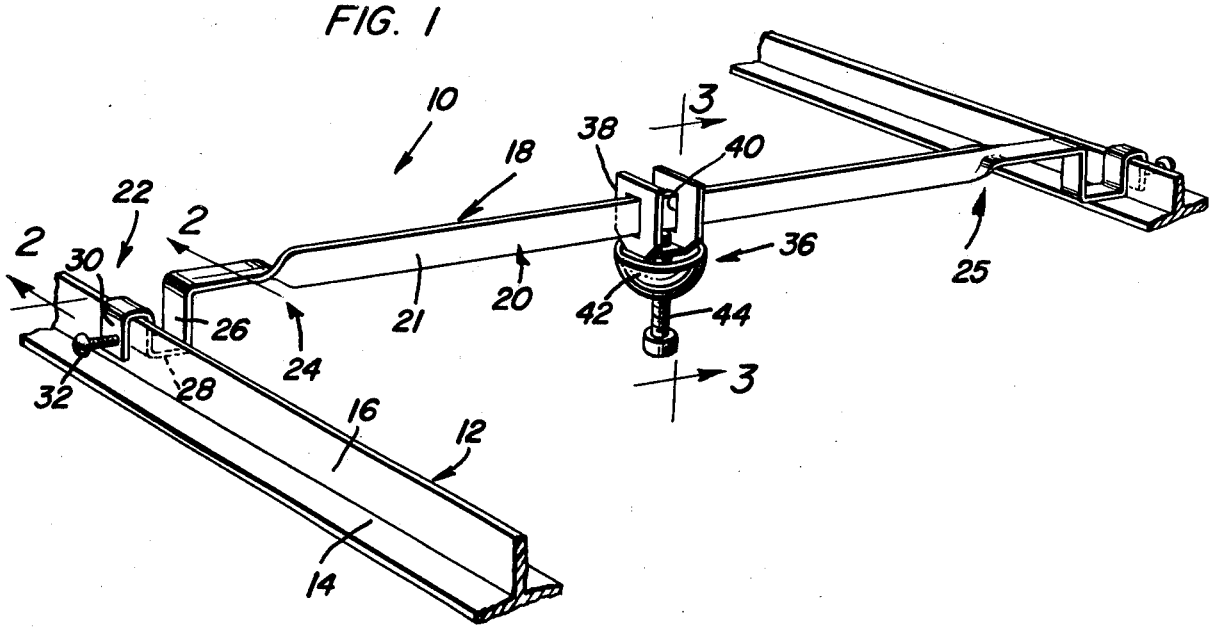
FIG. 1 is a perspective view illustrating a pair of parallel spaced inverted T-irons such as are used to form an openwork or grid suspension ceiling frame, the improved attachable and detachable prefabricated adapter structure of the invention being shown extending between the T-irons.
Figure 2:
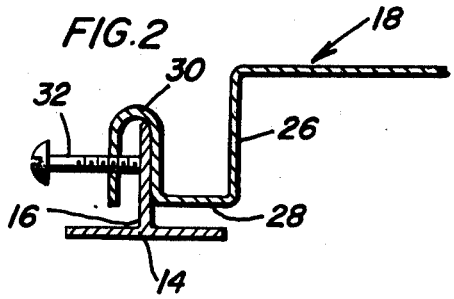
FIG. 2 is a detail sectional view taken along line 2—2 of FIG. 1.
Figure 3:
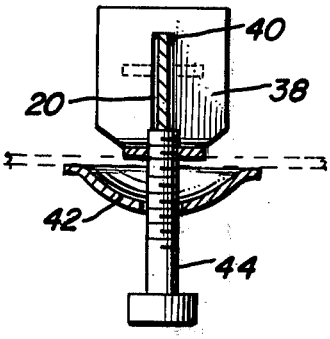
FIG. 3 is a detail sectional view taken along line 3—3 of FIG. 1.
Figure 4:
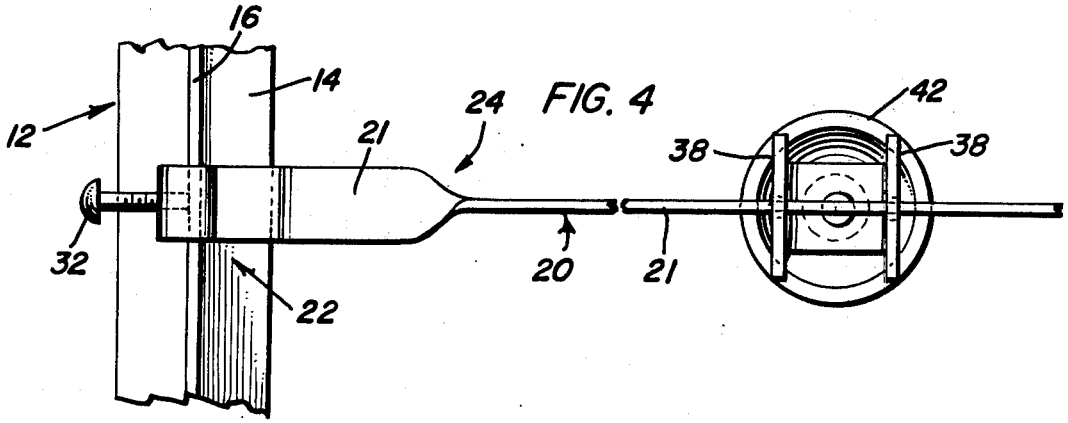
FIG. 4 is a detail plan view of a portion of the structure shown in FIG. 1.

Referring now to the drawings and particularly to FIG. 1, a fixture support adapter unit is seen generally at 10 to be mounted to a conventional suspension ceiling frame structure, the frame structure being comprised of a pair of parallel spaced inverted T-iron frame members 12. The paired space parallel coplanar frame members 12 are of conventional inverted T-shaped construction and are generally referred to as T-irons, the frame members 12 having horizontal flanges 14 and a vertical or upstanding flange 16. The adapter unit 10 is detachably and adjustably secured to the vertical flange 16 as will be described hereinafter. The adapter unit 10 is seen to comprise a single length of flat-faced strap mental which forms a body 18. End portions 22 are identical in structure and are configured to fit over the vertical flanges 16 of the frame members 12. Each end portion 22 has a vertical depending portion 26 and a horizontal depending portion 28 which, when installed, rests atop or adjacent the upper surface of a ceiling panel or block of conventional configuration. The terminal end of the horizontal depending portion 18 is joined with an inverted U-shaped hook 30, the hook fitting removably over the vertical flange 16. An outer leg of the hook, which is often referred to as the bill portion, is provided with an aperture through which a setscrew 32 extends to secure the hook 30 conveniently and accessibly in place on the frame member 12.

The body 18 of the adapter unit 10 takes the form of an elongated bar having major planar surfaces 21, a median portion 20 of the body 18 having the major planar surfaces 21 oriented with said surfaces 21 disposed vertically while the portions of the surfaces 21 adjacent the end portions 22 are oriented horizontally. Therefore, the bar-like body 18 can be said to be twisted at 24 and 25 to form the median portion 20, the planar surfaces 21 of the median portion 20 being turned at a 90 degree angle to the major planar surfaces of adjacent portions of the body. A conventional junction box (not shown) can be supported on the median portion 20 in a known manner, a clip 36 having vertically extending legs 38 extending through a slot in an upper wall of a conventional junction box, the legs 38 having vertical slots 40 formed therein through which the median portion 20 of the body 18 is received. The clip 36 can be moved along the median portion 20 and positioned as desired thereon. An assembly screw 44 can be used to hold a conventional threaded nipple 42 to the underside of the clip 36, the nipple 42 acting to maintain the junction box in place.

A junction box attached to the support adapter unit 10 can be slid freely along the entire length of the median portion 20 of the bar-like body 10 and can be secured by tightening of the screw 44 at any selected position, thereby providing adjustability in the placing and centering of the junction box and thus the fixture connected thereto. A fixture thereby mounted cannot be pushed upwardly or out of place since the junction box to which it is connected is secured on the body 18, the body 18 being secured at both ends to the T-iron frame members 12. Thus, the fixture is virtually immovable in spite of the fact that ceiling panels forming the suspension ceiling can be pushed out of place in the usual manner by a touch of the finger.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an openwork suspended ceiling frame structure embodying at least a pair of spaced parallel coplanar inverted T-iron frame members, an improved fixture support adapter unit adapted to bridge the space between coacting portions of the respective T-iron frame members, the adapter unit consisting of an elongated bar-like body having two major parallel planar surfaces and two minor parallel planar surfaces oriented transversely of said major surfaces, the body having a median portion, the major planar surfaces of which are vertically oriented, the major planar surfaces of end portions of the body adjacent the median portion being oriented horizontally, the median portion being thereby twisted edgewise relative to remaining portions of the body and further wherein end portions of the unit comprise U-shaped hook members having inner and outer legs joined at upper ends thereof by a connecting bight portion, said hook fitting onto a vertical flange portion of the frame member.

2. In the improved fixture support adapter unit of claim 1 wherein the end portions of the body are aligned in a straight line with the median portion of the body.

* * * * *